United States Patent [19]

Yirmiyahu et al.

[11] Patent Number: 4,783,053

[45] Date of Patent: Nov. 8, 1988

[54] DEVICE FOR FORCE-OPENING DOORS

[76] Inventors: Mordechai Yirmiyahu, Ancio Sereni Street 17, Givatayim; Benyamin Yirmiyahu, Maimon Street 52, Bnei-Brak, both of Israel

[21] Appl. No.: 56,697

[22] Filed: Jun. 2, 1987

[30] Foreign Application Priority Data

Nov. 7, 1986 [IL] Israel ..... 80536

[51] Int. Cl.[4] ..... B66F 3/00

[52] U.S. Cl. ..... 254/93 R; 72/705; 254/104; 29/239

[58] Field of Search ..... 72/705, 407; 29/239, 29/252, 253; 254/93 R, 104, 133 R, DIG. 4

[56] References Cited

U.S. PATENT DOCUMENTS

| | | | |
|---|---|---|---|
| 2,512,228 | 6/1950 | Fontaine | 72/705 |
| 3,625,046 | 12/1971 | Van Gompel | 72/705 |
| 3,891,187 | 6/1975 | Bearden | 254/93 R |
| 4,270,733 | 6/1981 | De Pue | 254/93 R |
| 4,273,311 | 6/1981 | Rio | 72/705 |
| 4,657,225 | 4/1987 | Hoehn et al. | 29/239 |
| 4,660,806 | 4/1987 | Masters | 254/93 R |

*Primary Examiner*—Robert C. Watson

*Attorney, Agent, or Firm*—Benjamin J. Barish

[57] ABSTRACT

A device for force-opening doors, comprises an anchoring member including two sections relatively movable from a retracted position permitting the anchoring member to be applied between the doorframe posts on opposite sides of the door, to an extended position bringing the opposite ends of the anchoring member into firm engagement with the doorframe posts to firmly anchor the anchoring member transversely across the door; and a ram member carried by the anchoring member for engagement with the door when the anchoring member is anchored to the doorframe transversely across the door. The ram member includes a hydraulic device for producing a large force against the door to force-open it; and the anchoring member also includes a hydraulic device for moving the two sections of the anchoring member into firm engagement with the doorframe posts.

15 Claims, 3 Drawing Sheets

6
8
14
16
20
22
24
26
28
30
32
34
36
38
40
40a
40b
42
44
46
48
50
52
54
56
58
60
62

DEVICE FOR FORCE-OPENING DOORS

BACKGROUND OF THE INVENTION

The present invention relates to a device for force-opening doors, particularly for use by fire departments, police departments, rescue squads, and the like, in order to break through a locked door.

There are occasions wherein it is necessary, for example by the fire department, police department or a rescue squad, to force-open a locked door. This is usually done by a brute-force technique, e.g., using a battering ram, sledge hammer or the like or blasting away the lock by a firearm. However, such techniques are accompanied by very loud noises, which is not always desirable. Moreover, the equipment needed, e.g., a battering ram, may not be conveniently available, may require a number of people, and/or may take a considerable period of time in order to force-open the door.

BRIEF SUMMARY OF THE INVENTION

An object of the present invention is to provide a device for force-opening doors having advantages in the above respects.

According to the present invention, there is provided a device for force-opening doors, comprising: an anchoring member including two sections relatively movable from a retracted position permitting the anchoring member to be applied between the doorframe posts on opposite sides of the door, to an extended position bringing the opposite ends of the anchoring member into firm engagement with the doorframe posts The opposite ends of each of the two sections of the anchoring member include a plate having a wedge at one side for wedging the plate between the door and the respective doorframe post, and at the opposite side, a face extending transversely to the longitudinal axis of the respective section and formed with a plurality of teeth which become embedded in the respective doorframe post when the two sections are moved to their extended positions, and thereby firmly anchor the anchoring member between the two doorframe posts. The device further includes a ram member carried by the anchoring member for engagement with the door when the anchoring member is anchored to the doorframe transversely across the door; the ram member including a force-multiplying device for producing a large force against the door to force-open it.

In the preferred embodiment described herein, the anchoring member also includes a force-multiplying device for moving the two sections of the anchoring member into firm engagement with the doorframe posts. More particularly, in the described preferred embodiment, the force-multiplying devices of both the anchoring member and of the ram member are fluid-operated pistons movable within cylinders, such as used in hydraulic jacks.

According to further features in the described preferred embodiment, the ram member is a separate member attachable to the anchoring member at the time of use; in addition, one of the sections of the anchoring member carries the force-multiplying device, and the other section of the anchoring member carries a mounting for the ram member permitting the ram member to be attached and selectively located thereon. In the described preferred embodiment, the mounting for the ram member on the other section of the anchoring member includes a pair of parallel, spaced bars, the ram member including a plate formed with a pair of parallel spaced slots for receiving the spaced bars of the anchoring member in a selected location thereof.

According to a further important feature in the described preferred embodiment, the free end of each of the two sections of the anchoring member is formed with a plurality of teeth adapted to be embedded in the doorframe posts when the two sections are moved to their extended positions in order to firmly anchor the anchoring member in the doorframe transversely across the door. The free end of each of the two sections of the anchoring member is preferably also formed with a wedge for wedging the end between the door and respective doorframe post.

The use of a device constructed in accordance with the foregoing features for force-opening doors provides a number of important advantages over the techniques now used for this purpose. Thus the device can be constructed as a relatively small, compact, portable unit which can be carried by one person to any desired location, anchored to the doorframe and then operated to force-open the door. In addition, the device is relatively quiet, fast-acting, capable of force-opening a wide variety of doors, and may be operated by only one or two persons.

Further features and advantages, as well as variations and modifications, of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
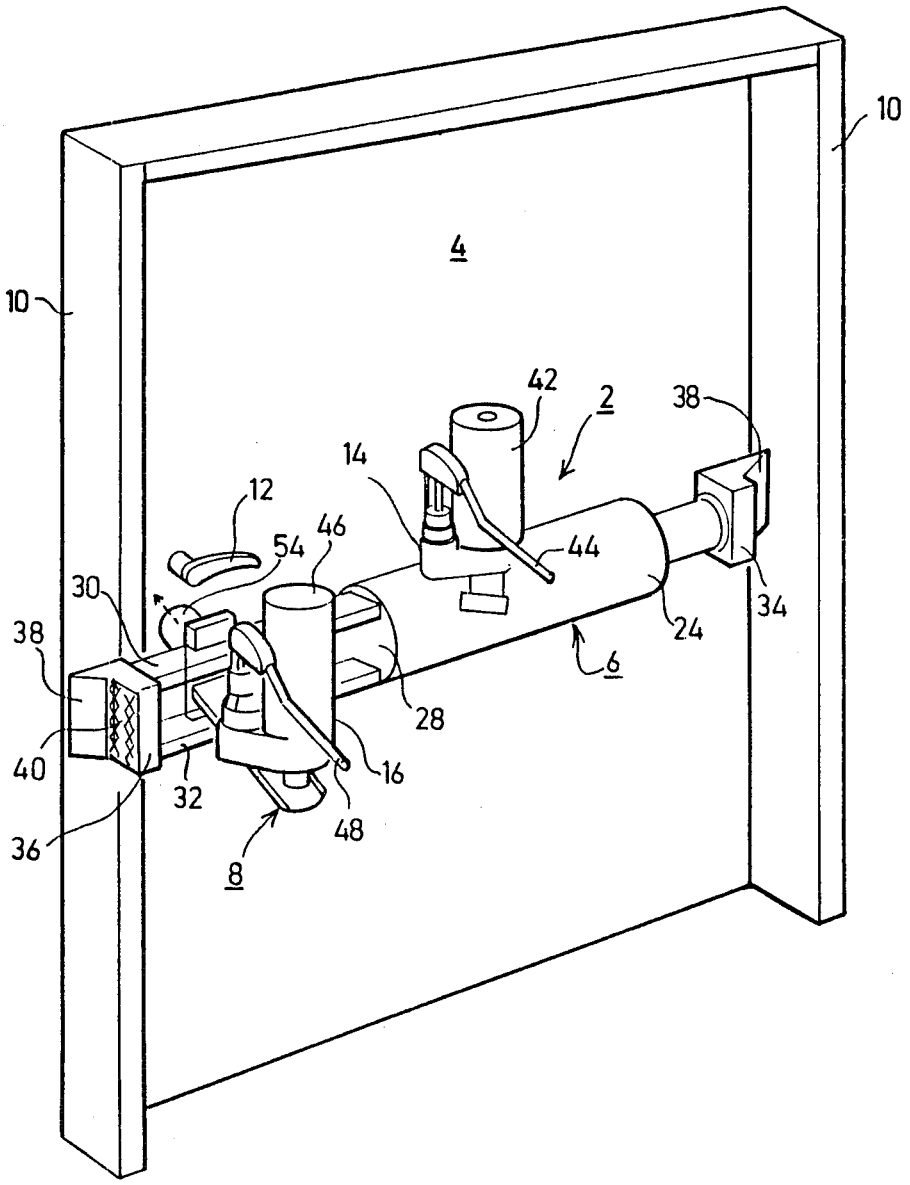
FIG. 1 illustrates one form of device constructed in accordance with the present invention in position for force-opening a door.

With reference first to FIG. 1, there is illustrated a device, generally designated 2, for force-opening a locked door 4. Device 2 includes two main members, namely an anchoring member generally designated 6, and a ram member generally designated 8. Anchoring member 6 is used for anchoring the device to the doorframe posts 10 on opposite sides of the door 4, and ram member 8 is used for producing a large force against the door in order to force it open. Ram member 8 may be located on anchoring member 6 at any desired position so as to apply the large force at the most effective location on the door, e.g., in alignment with the locking bolt which is usually adjacent to the door handle 12.

Anchoring member 6 includes a force-mulitiplying device 14 which is operated in order to firmly anchor the device to the doorframe. Ram member 8 also includes a force-multiplying device 16 for producing the large force against the door 4 in order to force-open it. In this illustrated preferred embodiment, both of the force-multiplying devices 14, 16 are fluid-operated devices, particularly hydraulically-actuated pistons and cylinders, as will be described more particularly below.

Figures 2, 3, 4:
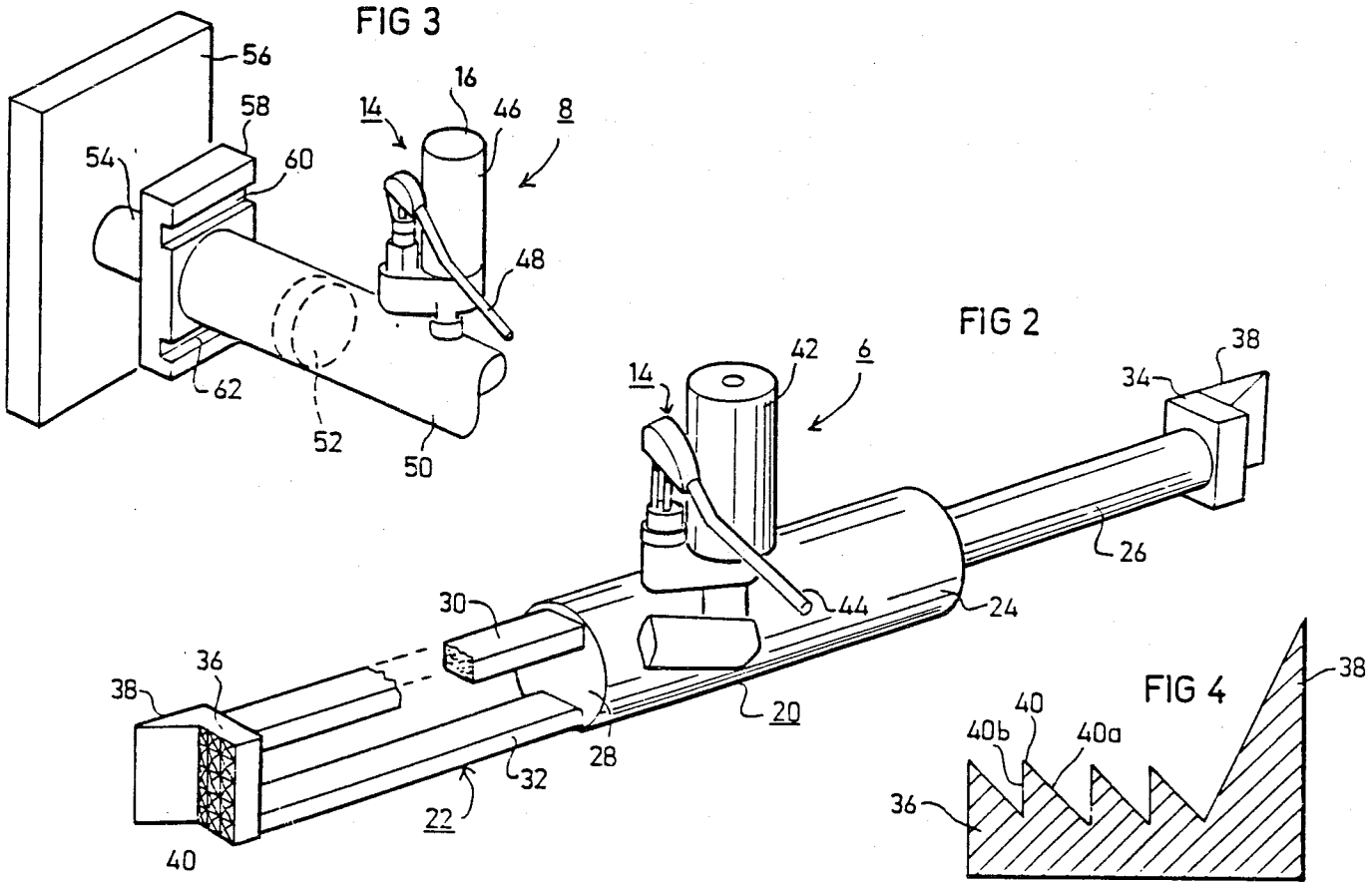
FIG. 2 illustrates the anchoring member in the device of FIG. 1.
FIG. 3 illustrates the ram member in the device of FIG. 1.
FIG. 4 is a fragmentary view illustrating the structure at the opposite ends of the anchoring member.

The construction of the anchoring member 2 is more particularly illustrated in FIG. 2, and the construction of ram member 8 is more particluarly illustrated in FIG. 3.

As shown in FIG. 2, the anchoring member 6 includes two relatively-movable sections, 20, 22, in a telescoping arrangement so as to permit the two sections to be moved relative to each other either to a retracted position in order to permit the anchoring member to be applied between the doorframe posts 10 on the opposite sides of the door 4, or to an extended position firmly anchoring the device to the doorframe posts extending transversely across the door as shown in FIG. 1. Thus, section 20 includes a cylinder 24 having a rigid bar 26 secured to one end and open at the opposite end; and section 22 includes a piston 28 movable within cylinder 20. A pair of spaced parallel bars 30, 32, are rigidly secured to piston 28. The outer free end of bar 26 of the cylinder section 20 carries a frame-engaging plate 34, and the outer ends of the two spaced bars 30, 32 of the piston section 22, carry a similar frame engaging-plate 36.

Both of the frame-engaging plates 34, 36 are of the same construction, as illustrated in FIG. 4 with respect to Plate 36. Thus, each plate is formed with a wedge 38 at one end for wedging the plate between the door 4 (FIG. 1) and the respective doorframe post 10, and a plurality of teeth 40 formed on a surface extending transversely to the longitudinal axis of the respective section 20, 22. Teeth 40 become embedded into the doorframe post when the two sections 20, 22 of the anchoring member 6 are moved to their extended positions in order to firmly anchor this member in the doorframe. Each of the teeth 40 includes an inclined face 40*a* to facilitate the penetration of the teeth into the doorframe post when applying the device, and a perpendicular face 40*b* resisting stripping of the plate 36 from the doorframe post when the ram member 8 is actuated to produce the large force applied against the door.

The hydraulic device 14 for extending the two sections 20, 22 of the anchoring member 6 may be of a type conventionally used in hydraulic jacks. It includes a reservoir 42 for the hydraulic fluid, and a handle 44 which is manually operated in order to pump the oil from reservoir 42 into cylinder 20 and thereby to act against piston 28 for extending section 22 with respect to section 20. Since such hydraulic devices are well known, for example in jacks as mentioned above, further details of its construction and operation are not set forth herein.

Hudraulic device 16 in ram member 8 illustrated in FIG. 3 also includes a reservoir 46 for the hydraulic fluid, and a handle 48 for pumping the hydraulic fluid into a cylinder 50. Movable within the cylinder is a piston 52 carrying a stem 54 projecting though the open end of the cylinder for applying the large door-opening force against the door 4. A plate 56 may be inserted between the outer end of stem 54 and the door in order to increase the surface area of the force applied by the stem against the door.

Ram member 8 may be selectively mounted at any desired position with respect to anchoring member 6. For this purpose, cylinder 50 of ram member 8 carries a metal plate 58 formed with a pair of slots 60, 62 adapted to receive the two spaced bars 30, 32 of the anchoring member 6. Thus, ram member 8 may be shifted along bars 30,32 to located piston stem 54 of the ram member at the most effective location of the door, e.g., aligned with a locking bolt, for force-opening the door when the ram member is actuated.

The manner of using the illustrated device will be apparent from the above description. The anchoring member 6 and the ram member 8 may be carried separately to the site of use and assembled there. Ram member 8 may be first applied to anchoring member 6 by retracting piston stem 54 so as to be flush with the outer face of plate 58, and then passing the ram member through the space between bars 30, 32 and seating the bars in slots 60, 62 of plate 58. Anchoring member 6 may then applied to the doorframe by inserting the wedged ends 38 of the end plates 34, 36 between the door and the respective doorframe posts. Hydraulic device 14 of anchoring member 6 is then actuated by operating manual lever 44 to extend the two sections 20, 22 of the anchoring member in order to embed the teeth 40 of the end plates 34, 36 into the doorframe posts 10 and thus firmly anchor member 6 in the doorframe transversely across the door. Ram member 8 may then be moved along bars 30, 32 to the desired location, and then hydraulic device 16 of ram member 8 may be actuated via its manual lever 46 to extend piston stem 54 under the great force produced by the hydraulic device 16, until the door is forced open.

Preferably, the two sections 20, 22 of anchoring member 6 are of substantially equal length so that ram member 8 may be positioned at the most effective location on the door in order to force the door open by the large force produced by the ram member.

Figure 5:
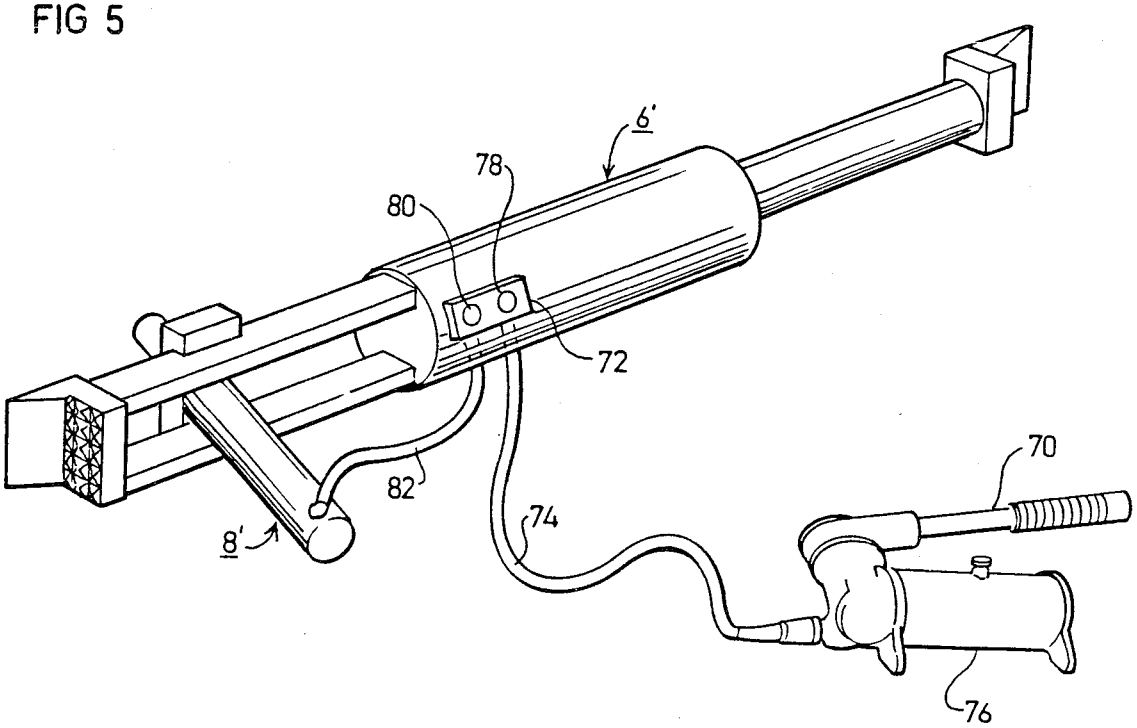
FIG. 5 illustrates another device constructed in accordance with the invention for force-opening doors.

FIG. 5 illustrates a variation in the construction described above with respect to FIGS. 1–4. Thus, whereas in the construction of FIGS. 1–4 a separate operator (44, 46) is provided for each of the two hydraulic devices included in the anchoring member 6 and ram member 8, respectively, FIG. 5 illustrates the variation wherein a single manual operator 70 is used for actuating both of the hydraulic devices. For this purpose, the arrangement in FIG. 5 includes a selector valve assembly 72 connected by a common tube 74 to a common reservoir 76 for the hydraulic fluid actuated by the common operator 70. Selector valve assembly 72 includes a push-button 78 for controlling a valve to direct the hydraulic fluid to the hydraulic device of the anchoring member 6', and another push-button 80 for controlling the valve to direct the hydraulic fluid via tube 82 to the hydraulic device of ram member 8'. In all other respects, the construction and operation of the device of FIG. 5 are the same as described above with respect to FIGS. 1–4.

It will be appreciated that many other variations may be made. For example, in some applications another force-multiplying device, such as a screw rather than a hydraulic device, may be provided for the anchoring member 6 and/or the ram member 8. In addition, instead of hydraulic devices, pneumatic devices may be used, and instead of a manual operator, there may be an electric operator.

Further variations, modifications and applications of the invention will be apparent.

What is claimed is:

1. A device for force-opening doors, comprising: an anchoring member including two sections relatively movable from a retracted position permitting the anchoring member to be applied between the doorframe posts on opposite sides of the door, to an extended position bringing the opposite ends of the two sections of the anchoring member into firm engagement with the doorframe posts; each of said opposite ends of the two sections of the anchoring member including a plate having a wedge at one side for wedging the plate between the door and the respective doorframe post, and at the opposite side, a face extending transversely to the longitudinal axis of the respective section and formed with a plurality of teeth which become embedded in the respective doorframe post when the two sections are moved to their extended positions, and thereby firmly anchor the anchoring member between the two doorframe posts; and a ram member carried by the anchoring member for engagement with the door when the anchoring member is anchored to the doorframe posts transversely across the door; said ram member including a force-multiplying device for producing a large force against the door to force-open it; said anchoring member also including a force-multiplying device for moving the two sections of the anchoring member into firm engagement with the doorframe posts.

2. The device according to claim 1, wherein said ram member is a separate member attachable to said anchoring member, one of said sections of the anchoring member carries said force-multiplying device, and the other section of the anchoring member carries a mounting for said ram member permitting said ram member to be attached and selectively located thereon.

3. The device according to claim 2, wherein said mounting for said ram member on the other section of the anchoring member includes a pair of parallel spaced bars, said ram member including a plate formed with a pair of parallel, spaced slots for receiving the pair of spaced bars of the anchoring member in a selected location thereof.

4. The device according to claim 1, wherein said force-multiplying device of the ram member is a fluid-operated device comprising a fluid-operated piston movable within a cylinder.

5. The device according to claim 4, wherein said force-multiplying device of the anchoring member is also a fluid-operated device comprising a fluid-operated piston movable within a cylinder.

6. The device according to claim 5, wherein said fluid-operated device of the anchoring member and ram member are hydraulic devices.

7. The device according to claim 6, wherein each of said hydraulic devices comprises a separate manual actuator.

8. The device according to claim 7, wherein both of said hydraulic devices comprise a common manual actuator and selector means for directing the hydraulic fluid either to the hydraulic device of the anchoring member or to the hydraulic device of the ram member.

9. The device according to claim 7, wherein both said hydraulic devices comprise a common power actuator and selector means for directing the hydraulic fluid either to the hydraulic device of the anchoring member or to the hydraulic device of the ram member.

10. A device for force-opening doors, comprising: an anchoring member including two sections relatively movable from a retracted position permitting the anchoring member to be applied between the doorframe posts on opposite sides of the door, to an extended position bringing the opposite ends of the two sections of the anchoring member into firm engagement with the doorframe posts; each of said opposite ends of the two sections of the anchoring member including a plate having a wedge at one side for wedging the plate between the door and the respective doorframe post, and at the opposite side, a face extending transversely to the longitudinal axis of the respective section and formed with a plurality of teeth which become embedded in the respective doorframe post when the two sections are moved to their extended positions, and thereby firmly anchor the anchoring member between the two doorframe posts; and a ram member carried by the anchoring member for engagement with the door when the anchoring member is anchored to the doorframe transversely across the door; said ram member including a piston-and-cylinder force-multiplying device for producing a large force against the door to force-open it; said anchoring member also including a force-multiplying device for moving the two sections of the anchoring member into firm engagement with the doorframe posts.

11. The device according to claim 10, wherein said ram member is a separate member attachable to said anchoring member, one of said sections of the anchoring member carries said force-multiplying device, and the other section of the anchoring member carries a mounting for said ram member permitting said ram member to be attached and selectively located thereon.

12. The device according to claim 11, wherein said mounting for said ram member on the other section of the anchoring member includes a pair of parallel spaced bars, said ram member including a plate formed with a pair of parallel, spaced slots for receiving the pair of spaced bars of the anchoring member in a selected location thereof.

13. A device for force-opening doors, comprising: an anchoring member including two sections relatively movable from a retracted position permitting the anchoring member to be applied between the doorframe posts on opposite sides of the door, to an extended position bringing the opposite ends of the two sections of the anchoring member into firm engagement with the doorframe posts; each of said opposite ends of the two sections of the anchoring member including a plate having a wedge at one side for wedging the plate between the door and the respective doorframe post, and at the opposite side, a face extending transversely to the longitudinal axis of the respective section and formed with a plurality of teeth which become embedded in the respective doorframe post when the two sections are moved to their extended positions, and thereby firmly anchor the anchoring member between the two doorframe posts; and a ram member carried by the anchoring member for engagement with the door when the anchoring member is anchored to the doorframe transversely across the door; said ram member including a hydraulic device for producing a large force against the door to force-open it.

14. The device according to claim 1, wherein said anchoring member also includes a hydraulic device for moving the two sections of the anchoring member into firm engagement with the doorframe posts.

15. The device according to claim 14, wherein said ram member is a separate member attachable to said anchoring member, one of said sections of the anchoring member carries said hydraulic device, and the other section of the anchoring member carries a mounting for said ram member permitting said ram member to be attached and selectively located thereon.

* * * * *